United States Patent [19]

Stoker et al.

[11] 4,289,082

[45] Sep. 15, 1981

[54] KNIFE BLOCK FOR TUFTING MACHINES

[75] Inventors: James E. Stoker, Chickamauga; John C. Powell, Rising Fawn, both of Ga.

[73] Assignee: Spencer Wright Industries, Inc., Chattanooga, Tenn.

[21] Appl. No.: 111,359

[22] Filed: Jan. 11, 1980

[51] Int. Cl.[3] ..... D05C 15/00

[52] U.S. Cl. ..... 112/79 R

[58] Field of Search ..... 112/79 R, 79 FF, 79.5

[56] References Cited

U.S. PATENT DOCUMENTS

| | | | |
|---|---|---|---|
| 3,277,852 | 10/1966 | Card | 66/79 R |
| 3,386,398 | 6/1968 | Cobble et al. | 66/79 R |
| 3,788,245 | 1/1974 | Bonner | 66/79 R |
| 4,061,095 | 12/1977 | Price | 66/79 R |
| 4,069,776 | 1/1976 | Cobble | 66/79 R |
| 4,175,497 | 11/1979 | Lund | 66/79 R |
| 4,193,360 | 3/1980 | Lund | 66/79 R |

FOREIGN PATENT DOCUMENTS

| | | | |
|---|---|---|---|
| 2856342 | 12/1979 | Fed. Rep. of Germany | 112/79 R |

*Primary Examiner*—Ronald Feldbaum
*Attorney, Agent, or Firm*—Alan Ruderman

[57] ABSTRACT

A knife block for mounting two knives in a staggered knife tufting machine and another knife block for mounting two knives in an aligned knife tufting machine have a pair of flanges connected together by a central web. A knife receiving channel is formed on each side of the web, each channel including a pair of aligned facing grooves in the flanges. A pair of circular bores extend transversely through one of the flanges and opens into the grooves in that flange. A cylindrical clamping member of slightly smaller diameter than the bores is positioned in each bore and forced by a screw threaded into the flange toward the other flange. The screw is received within a radial recess in the clamping member which is larger in diameter than the screw to allow for manufacturing tolerances so that the clamping member can clamp a knife in each channel. In the staggered knife block the clamping member has two different diameters.

6 Claims, 6 Drawing Figures

KNIFE BLOCK FOR TUFTING MACHINES

BACKGROUND OF THE INVENTION

This invention relates generally to tufting machines for forming cut pile fabric and more particularly to improved knife blocks for mounting the knives in such machines.

In tufting machines in which at least some of the tufts are cut, an oscillating knife cooperates with an oscillating hook or looper to cut the loop of yarn that has been seized by the looper from a corresponding needle. It is conventional in such machines for the knife to be supported and retained in a knife block carried by an oscillating knife bar. Examples of the known knife blocks are illustrated in Card U.S. Pat. No. 3,277,852; Cobble et al U.S. Pat. No. 3,386,398; Cobble U.S. Pat. No. 3,604,379; Wear U.S. Pat. No. 4,009,669 and British Pat. No. 1,309,961. Each of these patents discloses a knife block limited to mounting two or more conventionally aligned knives to cooperate with respective cooperating hooks having aligned throats. It is known, however, to produce a finer gauge of pile fabric by providing a tufting machine with parallel rows of staggered needles. In such machines the hooks which cooperate with adjacent offset needles may either have hooks with aligned throats, as illustrated in Crumbliss et al U.S. Pat. No. 3,913,505; Card U.S. Pat. No. 4,003,321 and Short U.S. Pat. No. 4,067,270; or the hooks may have throats offset by an amount substantially equal to that of the stagger, as illustrated in Card U.S. Pat. No. 3,084,644; Woodcock U.S. Pat. No. 3,440,983 and British Pat. No. 1,438,173. When the throats of the hooks are aligned the knives, which cut at the throats, are also aligned and conventional type knife blocks are adaptable. However, when the throats of adjacent hooks are offset, so too must be the knives and the knife receiving channels of multi-knife mounting blocks.

The use of said screws acting directly on the edges of the knives was previously discarded by the prior art because of the many difficulties presented. As illustrated in the aforesaid patents various constructions have been proposed for securing the knives within the knife block channels of blocks carrying aligned knives. These proposals use various forms and arrangements of clamping members which act on the rear edges of two of the knives. Many of these constructions require extensive machine work in the formation of the block and the formation of the clamping member. Moreover, in those tufting machines having non-aligned knives these prior art proposals are inapplicable because the rear edge of the knives are non-aligned.

SUMMARY OF THE INVENTION

Consequently, it is a primary object of the present invention to provide a knife block for tufting machines producing cut pile fabric including a simple inexpensive clamping member for securing at least two knives within the knife receiving channels.

It is another object of the present invention to provide a knife block for staggered needle tufting machines which produce cut pile fabric which includes improved clamping means for securing at least two non-aligned knives within respective channels in the block.

Accordingly the present invention provides a knife block having at least a pair of knife receiving channels on opposite sides of a substantially central web and at least one, but preferably two, circular bores extending through the body of the block transversely to the channels and opening onto the channels. In a knife designed for carrying aligned blades the bore extends into all the channels by a small substantially equal amount. A cylindrical clamping member, of slightly smaller diameter than the bore, is positioned within each bore, and a screw threaded into a flange of the knife block is loosely received within a recess in the clamping member to hold it in place and to force it against the knife blades. For knife blocks designed for carrying non-aligned blades, the cylindrical member has a portion of reduced diameter for clamping the knife in the channel disposed closer to the axis of the bore. In this case the diameter of the reduced portion is such that the difference between the radii of the major portion of the clamping member and the reduced portion is substantially equal to the offset or stagger of the knives and channels. The features of the invention are particularly well suited for knife blocks carrying two offset knives, and the blocks may be economically produced.

BRIEF DESCRIPTION OF THE DRAWING

The particular features and advantages of the invention as well as other objects will become apparent from the following description taken in connection with the accompanying drawings, in which:

Referring to FIG. 1 a pair of staggered tufting machine hooks or loopers 10 and 12 are shown as supported in a looper block 14 which is in turn supported by a block support bar 16. The block support bar 16 is suitably bolted to a rock shaft 18 for rocking the loopers 10 and 12 back and forth for picking up a loop of yarn from a needle (not shown) in a known manner. In cut pile machines the loopers 10 and 12 are generally rocked or oscillated into position for cooperating with a knife mechanism in timed relationship for cutting the loop of yarn to form cut pile.

Figure 1:
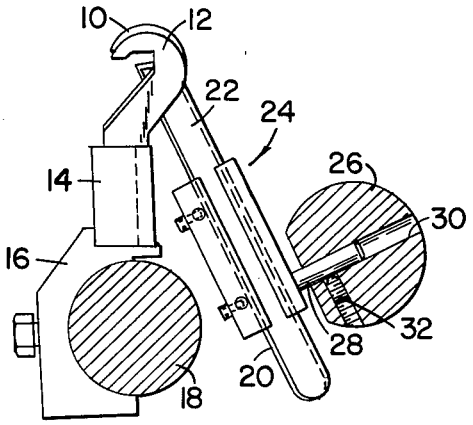
FIG. 1 is a side sectional elevational view taken through a hook and knife shaft of a staggered knife cut pile tufting machine, and disclosing a knife block constructed according to the principles of the present invention.

In order to carry out this objective, a plurality of cutting knives 20,22 are carried by a series of knife blocks generally indicated at 24. Each knife block in turn is supported on a rock shaft 26 by means of a support shaft or stud 28 integral with the block and received within a bore 30 within the shaft 26 and secured by a set screw 32 or the like. The knife blocks are thus oscillated by the rock shaft 26 back and forth into cutting engagement with the yarn on the looper.

Figure 2:
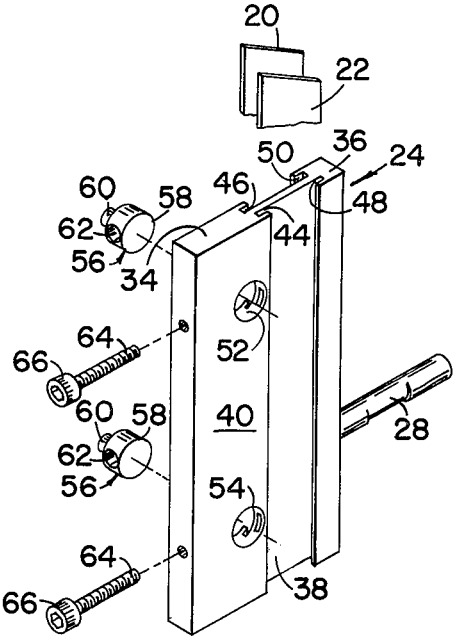
FIG. 2 is a perspective view of a two knife mounting block with the clamping members disassembled and the knives partly broken away.
Figure 3:
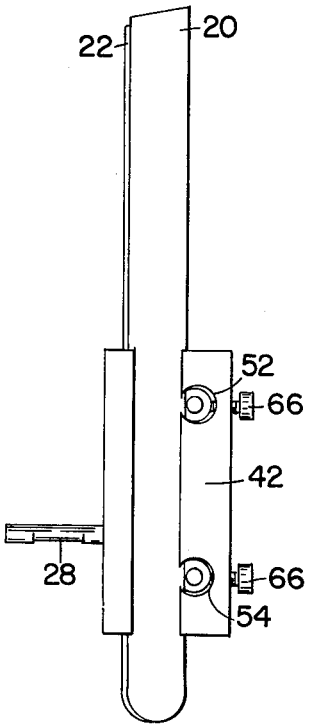
FIG. 3 is a side elevational view of one side of the knife block.
Figure 4:
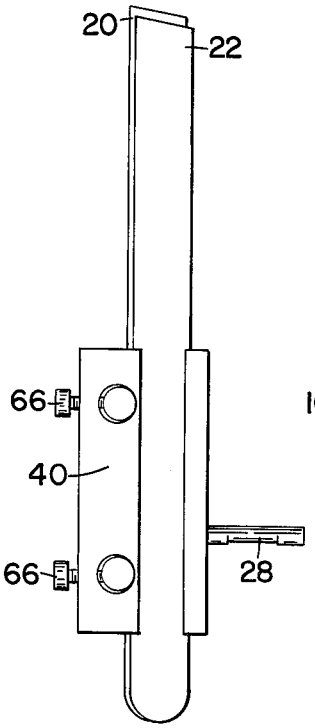
FIG. 4 is a side elevational view of the other side of the knife block.
Figure 5:
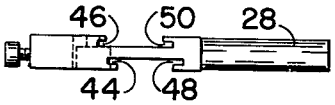
FIG. 5 is a top plan view of the knife block of FIGS. 2–4.

Referring now to FIGS. 2–4, it will be seen that a knife block 24 constructed in accordance with the present invention comprises a pair of longitudinally extending flanges 34 and 36 connected together by a web 38. The web preferably extends normal to the flanges, and intermediate side surfaces 40 and 42 of the block. Conventionally, knives 20 and 22 are received within knife receiving channels formed by undercutting grooves 44,46 into the flange 34 and grooves 48,50 into flange 36 adjacent each side of the web 38.

Formed transversely through one of the flanges, for example 34, is at least one, but as illustrated preferably two circular bores 52,54 extending through the surfaces 40 and 42. As illustrated for a non-aligned knife block, the bores open into the channels, extending only slightly more than tangent into the channel formed by the grooves 44, 48 and extending further into the channel formed by the grooves 46,50. For an aligned knife block the bores would be only slightly more than tangent to all the channels.

Figure 6:
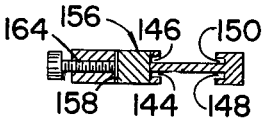
FIG. 6 is a sectional view through a modified block for mounting two aligned knives.

Positioned within each of the bores 52,54 is a clamping member 56. The clamping member is of a substantially cylindrical configuration slightly smaller in diameter than the diameter of the bores 52,54. A knife block designed for carrying aligned knife blades would have a clamping member with a substantially constant diameter as illustrated in FIG. 6, so that the clamping member would engage the edges of each knife in the channels. However as illustrated in FIGS. 2–5, for a knife block carrying non-aligned blades, the clamping member has a first cylindrical portion 58 and a second cylindrical portion 60 of a reduced diameter, the portion 58 being adapted to engage an edge of the knife in the channel defined by the grooves 44 and 48 while the portion 60 engages a knife in the other channel defined by the grooves 46 and 50.

Each clamping member 56 includes a radial recess 62 formed in the longitudinally extending surface thereof and substantially centrally disposed between the ends. A screw member 64 having a head 66 is threaded into and through flange 34 substantially in line with the center of each bore 52,54 and is extendable into the respective bore. The screw members have a diameter slightly smaller than the diameter of the recess 62 of each clamping member 56 so that they can be received within the recess to force the corresponding member 56 against the respective knife blade but yet allow the member to tilt slightly prior to seating of the screw member in the bottom of the recess. Thus, when the knives are seated in the channels the clamping members can tilt to correct for slight variations in the widths of the knives and production tolerances on the clamping members, and clamp against both knives when the screw members are tightened by rotating the heads 66. The clamping members, which can be produced economically on a conventional automatic screw machine, are prevented from falling from the bores even when the knives have been removed by reason of the screw members being within the recesses.

In a knife block constructed for mounting aligned knives, as illustrated in FIG. 6, the knife receiving channels are defined by grooves 144, 148 and 146,150. In this instance the clamping members 156 have a substantially constant diameter 158, but in all other respects are similar to the clamping members 56. Thus when the screws 164 are tightened into the recess in the clamping members 156 and the outer surface 158 acts against both knives carried by the block.

Numerous alterations of the structure herein disclosed will suggest themselves to those skilled in the art. However, it is to be understood that the present disclosure relates to the preferred embodiment of the invention which is for purpose of illustration only and not to be construed as a limitation of the invention. All such modifications which do not depart from the spirit of the invention are intended to be included within the scope of the appended claims.

Having thus described the nature of the invention, what is claimed herein is:

1. A knife block for a tufting machine comprising an elongated body member having a pair of longitudinally extending spaced flange portions connected together by a web, a knife receiving channel defined on each side of said web, each channel including a pair of longitudinally extending facing grooves in the flanges adjacent said web, at least one circular bore extending transversely through one of said flanges and opening onto the grooves disposed in said one flange, a cylindrical clamping member positioned in each bore and having a smaller diameter than said bore, said clamping member having a radial recess intermediate the extremities thereof and opening away from the other of said flanges, and screw means threadedly extending through said one flange into each bore and receivable within said recess for engaging said clamping member in said recess and forcing same toward the other flange, said screw member having a smaller cross sectional configuration then the recess for permitting tiltable movement of the clamping member into abuttment with a knife disposed in each of the grooves in said one flange.

2. A knife block as recited in claim 1 wherein said block includes a mounting shaft formed on the other of said flanges.

3. A knife block as recited in claim 1 wherein said block includes two bores spaced longitudinally in said one flange.

4. A knife block for a tufting machine comprising an elongated body member having a pair of longitudinally extending spaced flange portions connected together by a web, a knife receiving channel defined on each side of said web, each channel including a pair of longitudinally extending facing grooves in the flanges adjacent said web, at least one circular bore extending transversely through one of said flanges and opening onto the grooves disposed in said one flange, the pair of grooves on one side of said web being disposed more closely toward the axis of each bore than the pair of grooves on the other side of said web, a cylindrical clamping member positioned in each bore and having a smaller diameter than said bore, said clamping member having a radial recess intermediate the extremities thereof and opening away from the other of said flanges, and screw means threadedly extending through said one flange into each bore and receivable within said recess for engaging said clamping member in said recess and forcing same toward the other flange, said screw member having a smaller cross sectional configuration then the recess for permitting tiltable movement of the clamping member into abuttment with a knife disposed in each of the grooves in said one flange, said clamping member comprising a first portion having a first diameter for abutting the knife in the channel on said one side of said web, and a second portion having a larger diameter for abutting the knife in the channel on the other side of said web.

5. A knife block as recited in claim 4 wherein said block includes a mounting shaft formed on the other of said flanges.

6. A knife block as recited in claim 4 wherein said block includes two bores spaced longitudinally in said one flange.

* * * * *